United States Patent [19]

Meenan et al.

[11] Patent Number: 5,011,595

[45] Date of Patent: Apr. 30, 1991

[54] COMBINATION FEEDFORWARD-FEEDBACK FROTH FLOTATION CELL CONTROL SYSTEM

[75] Inventors: Gary F. Meenan; Hayward Oblad, both of Bethel Park, Pa.

[73] Assignee: Consolidation Coal Company, Pittsburgh, Pa.

[21] Appl. No.: 562,056

[22] Filed: Aug. 2, 1990

Related U.S. Application Data

[63] Continuation-in-part of Ser. No. 360,820, Jun. 2, 1989, abandoned.

[51] Int. Cl.[5] ..... B03D 1/00; B03D 1/02

[52] U.S. Cl. ..... 209/166; 209/1; 250/574

[58] Field of Search ..... 209/1, 164, 166, 167; 250/574

[56] References Cited

U.S. PATENT DOCUMENTS

| | | | |
|---|---|---|---|
| 3,332,744 | 7/1967 | Henderson | 209/166 |
| 3,551,897 | 12/1970 | Cooper | 209/166 |
| 4,559,134 | 12/1985 | Wasson | 209/166 |
| 4,731,176 | 3/1988 | MacDonald | 209/166 |
| 4,797,550 | 1/1989 | Nelson | 209/166 |
| 4,797,559 | 1/1989 | Oblad | 209/166 |

FOREIGN PATENT DOCUMENTS

| | | | |
|---|---|---|---|
| 757195 | 8/1980 | U.S.S.R. | 209/166 |
| 770548 | 10/1980 | U.S.S.R. | 209/166 |
| 893266 | 12/1981 | U.S.S.R. | 209/166 |
| 956023 | 9/1982 | U.S.S.R. | 209/166 |
| 1090447 | 5/1984 | U.S.S.R. | 209/166 |
| 1125054 | 11/1984 | U.S.S.R. | 209/166 |
| 1266563 | 10/1986 | U.S.S.R. | 209/166 |
| 819868 | 9/1959 | United Kingdom | 209/166 |
| 2182172 | 5/1987 | United Kingdom | 209/166 |
| 2188752 | 10/1987 | United Kingdom | 209/166 |

*Primary Examiner*—Stanley Silverman
*Assistant Examiner*—Thomas M. Lithgow
*Attorney, Agent, or Firm*—Alan McCartney

[57] ABSTRACT

A control system having optoelectric detectors responsive to different solids concentrations and character of the solids of a slurry, the signal of the detectors being input to a process controller which adjusts the rate of addition of chemicals to the feed stream of a froth cell to control the separation of solids from impurities. The impurities pass out of the cell as tailings. The controller calculates a feedforward output from the signals from detectors sensing different slurry conditions in the process feed stream, and the controller output adjusts the addition of different chemicals (additives) to the processing cell. The controller also calculates a feedback output after receiving a signal from a third detector in the tailings which monitors the extent of separation and recovery of solids from the processing cell.

2 Claims, 1 Drawing Sheet

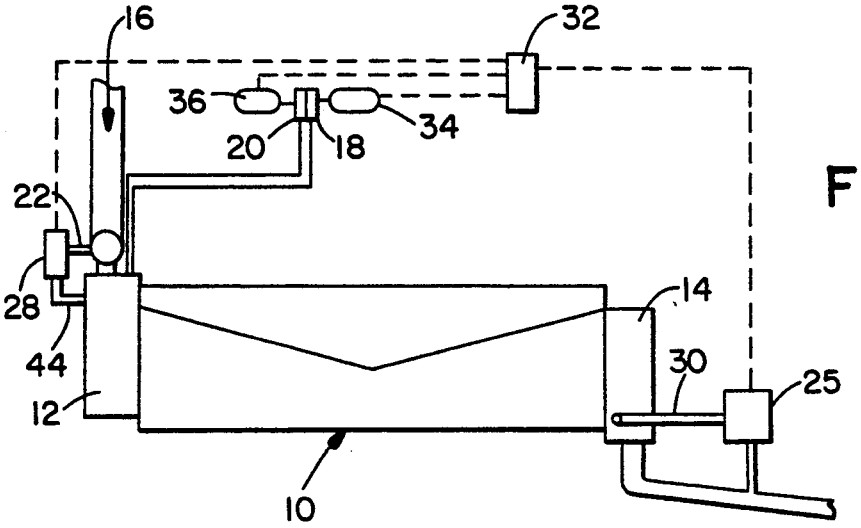
FIG. 1
FIG. 2
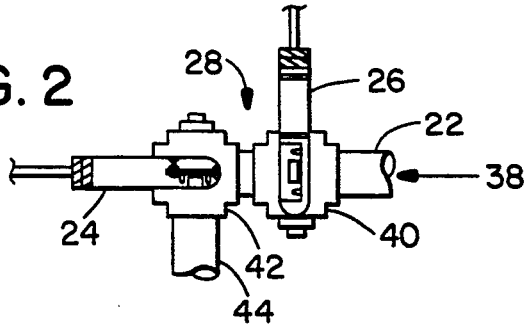
FIG. 3
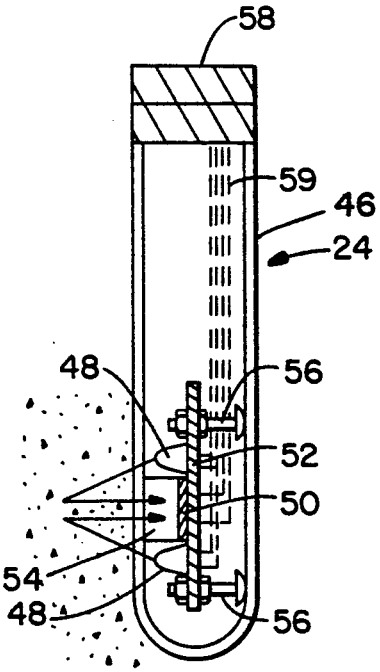
FIG. 4
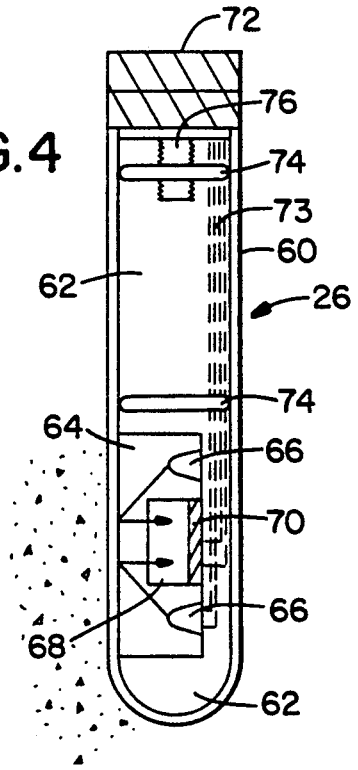

COMBINATION FEEDFORWARD-FEEDBACK FROTH FLOTATION CELL CONTROL SYSTEM

This application is a continuation in part of U.S. Pat. Application Ser. No. 360,820 filed June 2, 1989, now abandoned.

BACKGROUND OF THE INVENTION

1. Field of the Invention

This invention relates to an automatic system for controlling coal recovery in the froth flotation process.

2. State of the Prior Art

In the process of fine coal recovery, a coal slurry is passed to a flotation cell to which frother and collector are added to separate the coal from unwanted impurities such as clay. Various methods and apparatus have been used to automatically control the addition of the chemical additives to the flotation cell to optimize cell performance. U.K. Patent Applications GB 2188752A and GB 2182172A disclose comparing sensed solids content of the input stream to the diluted output stream of a froth flotation cell to readjust the addition of chemicals to the cell. U.K. Patent No. 819,868 utilizes a radioactive scanner of the filter cake to control the reagent feeder. U.S. Pat. No. 4,559,134 uses a particle size analyzer to control the addition of the collector.

Other devices such as nuclear densitometers, coriolis effect mass flow detector, magnetic flowmeters, dual bubbler tube densitometers and X-ray diffraction equipment have been used to monitor the flotation process, however, these devices are complicated and expensive and do not provide a simple physical reading of the coal content in the slurry to monitor cell operation.

SUMMARY OF THE INVENTION

It is the purpose of this invention to provide an automatic control of the recovery from a froth flotation cell by a feedforward detector of the solids content and quality of the slurry passing to the cell and a feedback detector of the quality of the cell tailings, the signal of either feedforward or feedback detector being processed in a controller that adjusts the variable speed pumps supplying additives to the cell, with the signal from the feedback or feedforward detector being processed in the controller to provide a multiplicative or additive correction to primary mode of control.

The advantage of this dual control system is that it overcomes the slow response of the feedback system with the feedforward component, and compensates for the 'blindness' of the feedforward system with the feedback component.

It is an object of this invention to provide a control system having feedforward detectors responding differently to solids concentrations and character of the solids of a feed stream, the signals from the detectors being fed to a digital process controller which calculates solids concentration and character of the solids to adjust variable speed pumps adjusting the addition of chemicals to the feed stream which passes to a froth cell. A feedback downstream detector responsive to the change in light backscattered from a slurry indicates the nature of the solids in the slurry. With the feedforward detectors being responsive in different manners to the solids concentration and nature of the solids, the signal output can be processed by a controller to determine which solid concentration has varied, and adjust the addition of the chemicals to the slurry. Additionally, the feedback detector responsive to the change in the light backscattered from the processed slurry can signal the controller to make any correction.

The system may also use the signal from the feedback detector as the main process control variable to which corrections may be made as the slurry entering the froth cell changes in concentration and character.

Furthermore, the detectors are immersed directly into the slurries and function without having to dilute the slurries prior to measurement.

BRIEF DESCRIPTION OF THE DRAWINGS

FIG. 1 is a schematic representation of the flotation cell process and the novel method and apparatus for adjusting the addition of frother and collector to the cell to optimize the coal/ash forming impurities separation in the cell;

FIG. 2 is an illustration of the feedforward detector mounted in a housing to receive a bypass stream of input slurry to the froth cells;

FIG. 3 is an illustration of the detector which is more sensitive to solids concentration of the slurry; and FIG. 4 is an illustration of the detector responsive to the character of the solids in a slurry feed stream.

DESCRIPTION OF THE PREFERRED EMBODIMENT

In the froth flotation process of separation of fine coal from impurities, a frother additive is mixed with the coal in a flotation cell and the slurry is agitated so that bubbles adhere to the coal and the coal rises to the surface of the cell and is removed. The ash forming impurities (clay, sand, etc.) travel through the cell and are removed from the opposite end and may be further processed. Often times a collector, such as fuel oil is added to the feed slurry to enhance the attachment of the bubbles to the coal.

Attention is directed to FIG. 1 which illustrates froth cells 10 having input and tailings boxes 12 and 14 respectively. A slurry of coal, ash forming impurities and water passes in line 16 to the cell to which frother and collector 18, 20 are added to separate the coal and impurities. In a by-pass line 22 are optoelectric sensors 24, 26 in housing 28 and in by-pass line 30 from the tailings box is a sensor 25. The output signal of sensors 24, 26 is processed in controller 32 to adjust the variable speed pumps 34, 36 and thus, the addition of the frother and collector to the cell. The output signal of sensor 25 is also processed in the controller 32 to ensure the control system is functioning correctly and that coal is being removed from the cell as desired.

In commonly owned U.S. Pat. Application Ser. No. 325,837 filed Mar. 20, 1989, there is disclosed a thickener feedforward control system having optoelectric detectors of two types, each being responsive to the detecting slurry solids concentration and the character of the solids in the slurry. The first detector is more or less responsive to the solids concentration and character of the slurry than the second detector. The output of the detectors is used to adjust the addition of different additives to the slurry to optimize solids settling from the slurry. The disclosure of said patent application is incorporated herein by reference.

In commonly owned U.S. Pat. No. 4,797,559, there is disclosed a feedback control system for a froth flotation cell in which an optoelectronic detector determines the character of the solids in a processed slurry and adjusts the addition of chemicals to the flotation cell to optimize cell performance. The disclosure in U.S. Pat. No. 4,797,559 is incorporated herein by reference.

It is the purpose of this invention to combine both the novel features of the feedforward system and the feedback system to control the functioning of a froth cell to optimize coal recovery from the cell.

FIG. 2 illustrates the detectors 24, 26 which are located in the bypass stream 38. The stream passes into the housing 40 containing detector 26 and then into the housing 42 of the detector 24 and into the conduit 44. The signals from the detectors 24, 26 are fed to the digital process controller 32 which adjusts the variable speed pumps 34, 36 to provide the correct amounts of frother and collector (additives) to the feed stream.

Attention is now directed to FIG. 3 which illustrates the detector 24 which is sensitive to both the solids concentration of the feed stream and clay content of the feed solids and FIG. 4 which illustrates the detector 26 which is mostly sensitive to the clay content of the solids. The detector 24 comprises a transparent tube 46 housing light emitting diodes (LEDs) 48 and photoconductor 50 supported on a mount 52. An opaque collar or barrier 54 is positioned between the LEDs 48 and the photoconductor 50 so that the light emitted passes into the feed stream and is reflected back (backscattered) to the photoconductor 50. The LEDs and photoconductor are separated by the collar or a barrier so that the emitted light must travel into the feed stream to be reflected and light from other pathways are thus excluded. The open end of the collar is shaped to match the inner surface of the tube. This permits this detector to be highly sensitive to the concentration of the solids in the feed stream. If the feed stream has a high coal concentration, more light will be absorbed by the feed stream and less light will be reflected to the photoconductor increasing the photoconductor resistance by an order of magnitude. The second detector 26 also sees the increase in coal content but differently than the first detector. These signal the process controller to adjust the pumps which add the frother and collector to the feed stream. Likewise, should the feed stream coal content decrease, more light will be reflected decreasing the resistances of the photoconductors to signal the controller to adjust the speed of pumps to add less chemicals to the feed stream. A stopper 58 encloses the end of tube 46 and the wires 59 from the LEDs and photoconductor pass through the stopper and are connected to the processor.

Attention is now directed to FIG. 4 which illustrates the detector 26 which is less sensitive to the slurry solids concentration but responsive to the change in clay content of the solids. The detector 26 comprises a transparent tube 60 into which a support 62 is positioned. The support follows the contour of the transparent tube and has a recess 64 onto which the LEDs 66, collar 68 and photoconductor 70 are positioned. A wire way 73 passes through the support 62 and out the stopper 72 permitting the wires to be connected to the controller. O-rings 74 are provided around the support 62 to securely mount the support 62 in the tube 60. A threaded opening 76 in the end of support 62 permits a bolt to be secured to the support 62 for removal of the support 62 from the tube 60 so that the support 62 can be reinserted into a new tube without changing the relationship of the detecting elements.

The collar 68 in detector 26 is recessed from the inner surface of the tube 60. When the collar is recessed from the tube wall, light bounces from the wall of the transparent tube into the collar. In effect, the transparent material acts as a mirror that has a backing that changes reflectivity with solids/clay content. Light reflects to the photoconductor off the slurry/tube interface and the inner wall of the tube. Since the light which bounces off the inner wall of the tube does not depend on slurry quality, it illuminates the photoconductor constantly and, if not eliminated, it limits the variance in the resistance which is achieved. Proper design and construction ensures an adequate sensitivity span of the detector. In the event the clay or coal content of the solids changes (thus slurry color changes), then the change of the reflectivity from the surface of tube 60 will change the output of the photoconductor, which, through the controller will monitor the function of the feedforward detector.

Both the feedforward detectors are responsive to a change in solids concentration and the nature of the solid which changed in concentration based upon the reflection of the light from the slurry to affect the resistance of the photoconductor in the sensors. Because the sensors are responsive in different manners, a reading can be obtained of the specific solid which has changed in concentration, and thus the frother and collector can be increased or decreased as required.

For example, should the solids concentration increase as a result of increase in coal concentration, less light is reflected (FIG. 3 unit) increasing the resistance of photoconductor 50. At the same time, the photoconductor 70 of FIG. 4 would also see the increased coal content (less reflectance) and the sensor inputs would be combined in the controller. Should the increased solids concentration result from an increased clay concentration (impurities) of the slurry more light would be reflected to the FIG. 3 detector decreasing the resistance of the photoconductor. Since the FIG. 4 detector is more responsive to change in slurry color—clay content—there would be a more significant decrease in the resistance of photoconductor 70. The determination of which solid increased in concentration can be accomplished by one detector strongly responsive to both solids concentration of the slurry and the clay content of the solids (detector 24) and another detector responsive to clay content and weak in response to the solids concentration of the slurry (detector 26).

However, in any given period of time, changes in solids concentration will be caused by increases or decreases of the clay and coal concentrations simultaneously and because the detectors read not only the solids concentration but also the nature of the solids in different signal outputs, all parameters of change are determined in the controller. By having two variables—coal content, clay content and two sensors, each responsive to a change in the variables in different degrees, all parameters of change are simultaneously seen by both sensors which signal the controller which determines the change and adjusts the pumps accordingly.

Thus, it can be seen that the rate of addition of the frother and collector to a feed stream to a froth cell can be adjusted by knowing the solids concentration and character of the solids. Since the feed rate of slurry normally remains constant to a froth cell, by using the two types of optoelectronic devices, each with differing sensitivities to the solids concentration and clay content of the solids, a feedforward control system for coal recovery is obtained.

With detector 24 being more sensitive to solids concentration than detector 26, the signals from the two detectors are fed to a digital process controller which calculates the solids concentration of the slurry and the clay content of the solids. The controller then adjusts the variable speed pumps to provide the correct amounts of frother and collector to the froth cell.

In the combination control system of this invention, an optoelectronic detector 25 of the type of detector 26 is placed in the tailings to monitor coal recovery and correct the controller output derived from the combined detectors 24 and 26. Since the detector 24 is responsive to the change in color in the stream, the coal/clay content of the tailings can be monitored.

For example, as the coal content of the tailings increases, the coal absorbs the light and as the coal content decreases, the hue of gray of the tailings lightens, reflecting more light. This variation in coal content will change the amount of backscattered light sensed by the photoconductor 50. This change in the resistance in the photoelectric sensor signals the process controller. Basically, since the resistance of the photosensor is related to the reflectivity of the tailings slurry, and the reflectivity of the slurry depends on the coal and clay contents, then the resistance of the cell can be correlated to the coal/clay content to monitor coal recovery in the flotation cell. Should the feedback of the detector 25 indicate too little coal is being removed from the cell, the process controller can make a correction to the output from the controller and adjust pumps 34 and 36 accordingly. Likewise, the combined detectors 24 and 26 can be used to foresee a change in the feed slurry and correct the controller output derived from the feedback detector.

It thus can be seen that a froth flotation control system can be configured from the two types of optoelectronic detectors as shown in FIGS. 3 and 4. The main control for the froth cell might be based on a signal derived from the feed slurry to the froth cell. As shown in FIG. 1, the signal would be received by a process controller which would adjust the output rate of the frother and oil pumps to match the requirements of the material reporting to the froth cell. This is known as feedforward control or predictive control. In addition, an optoelectronic detector is also installed to inspect the tailings. This secondary detector would ensure that the equation used in the feedforward control calculation was correct and that the coal was being removed as desired. This second part would be the feedback portion of the control scheme.

The controller would calculate the solids concentration and clay content of the solids in the feed slurry. The frother and collector feed rates to the froth cells would be calculated based on the feed rate of the non-ash forming material (coal) to the froth cell. It is assumed that the mass feed rate of water to the froth cell is constant. If the amount of frother and collector (oil) that was supplied to the cell was too much or too little, then the secondary detector which estimates the quality of the tailings would cause either a multiplicative or additive correction to the feedforward control calculation.

It can also be seen that a froth flotation control system might be based on using the signal derived from the tailings slurry as the main control parameter which would be corrected or adjusted by the feedforward portion of the system. In this case, the adjustments are made to the pumps long before the changes in the slurry are 'seen' in the tailings by the feedback detector.

We claim:

1. A system apparatus for automatically controlling the recovery of solids from a feed slurry passing into a froth flotation cell to which additives are supplied to separate the solids from impurities with the solids and impurities having different light reflective characteristics and the impurities passing from the flotation cell as tailings comprising:

(a) a flotation cell apparatus comprising a flotation cell, means to feed said slurry containing said solids and impurities to said flotation cell, means for removing a fraction from said flotation cell containing a concentrated portion of said solids and means for removing a tailings fraction from said flotation cell containing a concentrated portion of impurities and a minor amount of said solids, (b) a first means coacting with the feed slurry passing into the cell responsive to the light reflective characteristics of the solids, said first means comprising a first optoelectric detector having a transparent tube containing light emitting diode means for emitting light into the feed slurry and a photoconductor means for generating a signal in response to light reflected from the solids and means to send said signal to a controller means, (c) a second means coacting with said feed slurry passing into the cell responsive to the light reflective characteristics of the impurities and comprising a second optoelectric detector having a transparent tube containing light emitting diode means for emitting light onto the feed slurry and a photoconductor means for generating a second signal in response to light reflected from the impurities and means to send said second signal to said controller means, (d) said first and second detectors each have opaque barriers separating the diode means from the photoconductor means, the barrier in said first detector extending from between said diode means and said photoconductor means to at least the inner surface of the tube and the barrier in said second detector extending from between said diode means and said photoconductor means to a location spaced from the inner surface of the tube, and (e) a third means coacting with the tailings having means responsive to the light reflective characteristics of the impurities and means to generate and send a feedback signal to said controller means of the impurities concentration of the tailings, (f) said controller means comprising means to receive said signals from said first, second and third means and means to generate a control signal in response to said received signals, (g) additive feed means for variably supplying said additives to the flotation cell comprising means to receive said control signal from said controller means and means to vary the addition of said additives to the flotation cell in response to said received control signal.

2. The system apparatus of claim 1 wherein said third means is an optoelectric detector having the same diode means, photoconductor means and barrier as said second means.

* * * * *